US010122060B2

(12) United States Patent
Asada

(10) Patent No.: US 10,122,060 B2
(45) Date of Patent: Nov. 6, 2018

(54) HIGH-FREQUENCY ELECTRONIC COMPONENT

(71) Applicant: Murata Manufacturing Co., Ltd., Nagaokakyo-shi, Kyoto-fu (JP)

(72) Inventor: Satoshi Asada, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 7 days.

(21) Appl. No.: 15/629,827

(22) Filed: Jun. 22, 2017

(65) Prior Publication Data

US 2017/0373367 A1 Dec. 28, 2017

(30) Foreign Application Priority Data

Jun. 27, 2016 (JP) ..... 2016-126327

(51) Int. Cl.
*H01P 5/12* (2006.01)
*H01P 5/16* (2006.01)

(52) U.S. Cl.
CPC . *H01P 5/16* (2013.01); *H01P 5/12* (2013.01)

(58) Field of Classification Search
CPC ..... H01P 5/10; H01P 5/12; H01P 5/16
USPC ..... 333/126–135
See application file for complete search history.

(56) References Cited

FOREIGN PATENT DOCUMENTS

JP 2002-344276 A 11/2002

*Primary Examiner* — Robert J Pascal
*Assistant Examiner* — Kimberly Glenn
(74) *Attorney, Agent, or Firm* — Keating & Bennett, LLP

(57) ABSTRACT

A high-frequency electronic component includes a multilayer body including a first input/output electrode, a second input/output electrode, and a third input/output electrode, and a first input/output path and a second input/output path. The first input/output path includes a first inductor and a first capacitor. The second input/output path includes a second inductor and the first capacitor. The first input/output electrode is located at a position deviated from a symmetric axis along a short-side direction of one main surface of the multilayer body. A distance from the first input/output electrode to a winding portion of the first inductor is larger than a distance from the first input/output electrode to a winding portion of the second inductor, and an inductance of the first inductor is larger than an inductance of the second inductor.

17 Claims, 11 Drawing Sheets

HIGH-FREQUENCY ELECTRONIC COMPONENT

CROSS REFERENCE TO RELATED APPLICATIONS

This application claims the benefit of priority to Japanese Patent Application No. 2016-126327 filed on Jun. 27, 2016. The entire contents of this application are hereby incorporated herein by reference.

BACKGROUND OF THE INVENTION

1. Field of the Invention

The present invention relates to a high-frequency electronic component, and in particular, relates to an electronic component (hereinafter, referred to as a divider) distributing a high-frequency signal and an electronic component (hereinafter, referred to as a combiner) synthesizing high-frequency signals.

2. Description of the Related Art

A divider distributing a high-frequency signal and a combiner synthesizing high-frequency signals are used as high-frequency electronic components in a mobile communication apparatus such as a cellular phone. A high-frequency electronic component disclosed in Japanese Unexamined Patent Application Publication No. 2002-344276 is an example of the divider and the combiner. FIG. 9 is an outer appearance perspective view of a high-frequency electronic component 200 disclosed in Japanese Unexamined Patent Application Publication No. 2002-344276. FIG. 10 is a circuit diagram of the high-frequency electronic component 200. FIG. 11 is an exploded perspective view of a multilayer body 210 included in the high-frequency electronic component 200 disclosed in Japanese Unexamined Patent Application Publication No. 2002-344276.

The high-frequency electronic component 200 includes the multilayer body 210 having a rectangular or substantially rectangular parallelepiped shape and six outer electrodes. The outer electrodes include three electrodes provided over one main surface, one side surface, and the other main surface of the multilayer body 210 and three electrodes provided over the one main surface, the other side surface, which opposes the one side surface, and the other main surface thereof.

The outer electrodes provided at the one side surface side of the multilayer body 210 are a first input/output electrode 201 and ground electrodes 204 and 205. The outer electrodes provided at the other side surface side thereof are a second input/output electrode 202, a third input/output electrode 203, and a ground electrode 206. That is to say, the first input/output electrode 201 is an input electrode of a divider or an output electrode of a combiner, and the second input/output electrode 202 and the third input/output electrode 203 are output electrodes of the divider or input electrodes of the combiner.

It should be noted that the high-frequency electronic component 200 further includes a resistor R201 provided on the upper surface of the multilayer body 210 and connecting the second input/output electrode 202 and the third input/output electrode 203.

The multilayer body 210 includes insulating layers 210*a* to 210*f* and pattern conductors P201 to P209. In the multilayer body 210, the pattern conductors P201 and P203 are connected to each other by a via conductor (indicated by a dashed-dotted line) and configures a first inductor L201. In the same manner, the pattern conductors P202 and P204 define a second inductor L202.

The pattern conductors P205, P206, and P209 define a first capacitor C201. The pattern conductors P205, P207, and P209 define a second capacitor C202. The pattern conductors P205, P208, and P209 define a third capacitor C203.

The pattern conductor P206 is connected to the first input/output electrode 201. The pattern conductor P207 is connected to the second input/output electrode 202. The pattern conductor P208 is connected to the third input/output electrode 203. Each of the pattern conductors P205 and P209 is connected to the ground electrodes 204 to 206. Accordingly, one ends of the first capacitor C201, the second capacitor C202, and the third capacitor C203 are grounded under a usage environment of the high-frequency electronic component 200.

That is to say, the first input/output electrode 201, the first inductor L201, the first capacitor C201 and the second capacitor C202, and the second input/output electrode 202 define a first input/output path PW201. The first input/output electrode 201, the second inductor L202, the first capacitor C201 and the third capacitor C203, and the third input/output electrode 203 define a second input/output path PW202.

Among the three outer electrodes at the one side surface side of the multilayer body 210, the first input/output electrode 201 is arranged at the center and the ground electrodes 204 and 205 are arranged at both of the sides thereof. Furthermore, among the three outer electrodes at the other side surface side of the multilayer body 210, the ground electrode 206 is arranged at the center and the second input/output electrode 202 and the third input/output electrode 203 are arranged at both of the sides thereof.

In the high-frequency electronic component 200, projection views of the first inductor L201 and the second inductor L202 when the multilayer body 210 is seen through from the other main surface (upper surface) are line symmetric to each other with respect to a symmetric axis (line A3-A3 in FIG. 11) along the short-side direction of the other main surface of the multilayer body 210. Furthermore, a projection view of the first capacitor C201 is line symmetric by itself with respect to the symmetric axis along the short-side direction of the other main surface of the multilayer body 210. The projection view of the second capacitor C202 and the projection view of the third capacitor C203 are line symmetric to each other with respect to the symmetric axis along the short-side direction of the other main surface of the multilayer body 210.

The projection view of the first inductor L201 is obtained by projecting the first inductor L201 having a three-dimensional stereoscopic structure onto a two-dimensional plan view when seen from the other main surface (upper surface) side of the multilayer body 210. The projection views of the second inductor L202, and the first capacitor C201, the second capacitor C202 and the third capacitor C203 are obtained in the same manner.

In recent years, for example, a divider and a combiner having four outer electrodes for reducing a high-frequency electronic component in size and conversely, a divider and a combiner having eight outer electrodes for increasing a high-frequency electronic component in size have been required and developed. When the number of outer electrodes is four or eight as described above, the first input/output electrode cannot be arranged on the symmetric axis along the short-side direction of the other main surface of the multilayer body. That is to say, a distance from the first input/output electrode to a winding portion of the first inductor and a distance from the first input/output electrode to a winding portion of the second inductor are different from each other.

As a result, insertion loss of the above-described first input/output path and insertion loss of the second input/output path are different from each other. Accordingly, a signal passing through the first input/output path and a signal passing through the second input/output path, which should have the same bandpass characteristics originally, have different bandpass characteristics.

SUMMARY OF THE INVENTION

Accordingly, preferred embodiments of the present invention provide high-frequency electronic components that distribute a high-frequency signal or synthesize high-frequency signals, wherein a first input/output path and a second input/output path have a same insertion loss or a substantially same insertion loss even when a first input/output electrode is located at an asymmetric position on a main surface of a multilayer body.

Preferred embodiments of the present invention improve shapes of components of a first input/output path and a second input/output path in high-frequency electronic components that distribute a high-frequency signal or synthesize high-frequency signals.

A high-frequency electronic component according to a first preferred embodiment of the present invention includes a multilayer body with a rectangular or rectangular or substantially rectangular parallelepiped shape, a first input/output electrode, a second input/output electrode, and a third input/output electrode. The first input/output electrode is provided on one main surface and one side surface of the multilayer body. The second input/output electrode and the third input/output electrode are provided on the one main surface and the other side surface, which opposes the one side surface, of the multilayer body.

Furthermore, the high-frequency electronic component according to the first preferred embodiment of the present invention includes a first input/output path and a second input/output path. The first input/output path includes the first input/output electrode, the second input/output electrode, and a first inductor and a first capacitor connected between the first input/output electrode and the second input/output electrode. The second input/output path includes the first input/output electrode, the third input/output electrode, and a second inductor and the first capacitor connected between the first input/output electrode and the third input/output electrode.

The first input/output electrode is provided at a position deviated from a symmetric axis along a short-side direction of the one main surface of the multilayer body. A distance from the first input/output electrode to a winding portion of the first inductor is larger than a distance from the first input/output electrode to a winding portion of the second inductor. An inductance of the first inductor is larger than an inductance of the second inductor.

The winding portion of the first inductor corresponds to a ring-shaped or substantially ring-shaped portion obtained by projecting the first inductor having a three-dimensional stereoscopic structure onto a two-dimensional plan view when seen from the other main surface (upper surface) side of the multilayer body, as illustrated in FIG. 4, which will be described later.

The high-frequency electronic component having the above-described configuration compensates for a difference in insertion loss, which is generated because the distance from the first input/output electrode to the winding portion of the first inductor is larger than the distance from the first input/output electrode to the winding portion of the second inductor. As a result, even when the first input/output electrode is located at an asymmetric position on the other main surface of the multilayer body, the insertion loss of the first input/output path and the insertion loss of the second input/output path are equal or substantially equal to each other.

What the insertion loss of the first input/output path and the insertion loss of the second input/output path are equal or substantially equal to each other does not mean is that they are strictly equal to each other but is a concept including the case in which there is a difference in a range of generating no problem in an actual usage environment, for example, a difference of approximately ±0.05 dB.

It is preferable that the high-frequency electronic component according to the first preferred embodiment of the present invention have the following characteristics. That is to say, an area of a region surrounded by an outer circumference of a projection view of the first inductor is larger than an area of a region surrounded by an outer circumference of a projection view of the second inductor.

The area of the region surrounded by the outer circumference of the projection view of the first inductor indicates an area of an inner side portion of the region surrounded by the outer circumference of the ring-shaped or substantially ring-shaped projection view obtained by projecting the first inductor having the three-dimensional stereoscopic structure onto the two-dimensional plan view when seen from the other main surface (upper surface) side of the multilayer body. Furthermore, the same holds true for the area of the region surrounded by the outer circumference of the projection view of the second inductor.

In the high-frequency electronic component having the above-described configuration, even when the first input/output electrode is located at an asymmetric position on the other main surface of the multilayer body, the insertion loss of the first input/output path and the insertion loss of the second input/output path are equal or substantially equal to each other by making the length of the winding portion of the first inductor be larger than the length of the winding portion of the second inductor.

A high-frequency electronic component according to a second preferred embodiment of the present invention includes a multilayer body with a rectangular or rectangular or substantially rectangular parallelepiped shape, a first input/output electrode, a second input/output electrode, and a third input/output electrode, which are the same as those in the high-frequency electronic component according to the first preferred embodiment.

Furthermore, the high-frequency electronic component according to the second preferred embodiment of the present invention includes a first input/output path and a second input/output path. The first input/output path includes the first input/output electrode, the second input/output electrode, and a first inductor, and a first capacitor and a second capacitor connected between the first input/output electrode and the second input/output electrode. The second input/output path includes the first input/output electrode, the third input/output electrode, and a second inductor, and the first capacitor and a third capacitor connected between the first input/output electrode and the third input/output electrode.

The first input/output electrode is provided at a position deviated from a symmetric axis along a short-side direction of the one main surface of the multilayer body. A distance from the first input/output electrode to a winding portion of the first inductor is larger than a distance from the first input/output electrode to a winding portion of the second inductor. A capacitance of the second capacitor is smaller than a capacitance of the third capacitor.

The high-frequency electronic component having the above-described configuration is also able to fill a difference in insertion loss, which is generated because the distance from the first input/output electrode to the winding portion of the first inductor is larger than the distance from the first input/output electrode to the winding portion of the second inductor. As a result, even when the first input/output electrode is located at an asymmetric position on the other main surface of the multilayer body, the insertion loss of the first input/output path and the insertion loss of the second input/output path are equal or substantially equal to each other.

It is preferable that the high-frequency electronic component according to the second preferred embodiment of the present invention have the following characteristics. That is to say, an area of a projection view of the second capacitor is smaller than an area of a projection view of the third capacitor.

The area of the projection view of the second capacitor indicates an area of a rectangular or substantially rectangular projection view obtained by projecting the second capacitor onto a two-dimensional plan view when seen from the other main surface (upper surface) side of the multilayer body. Furthermore, the same holds true for the area of the projection view of the third capacitor.

In the high-frequency electronic component having the above-described configuration, even when the first input/output electrode is located at an asymmetric position on the other main surface of the multilayer body, the insertion loss of the first input/output path and the insertion loss of the second input/output path are equal or substantially equal to each other by making the electrode area of the second capacitor be smaller than the electrode area of the third capacitor.

It is preferable that the high-frequency electronic component according to the second preferred embodiment of the present invention have the following characteristics. That is to say, an area of a region surrounded by an outer circumference of a projection view of the first inductor is larger than an area of a region surrounded by an outer circumference of a projection view of the second inductor.

In the high-frequency electronic component having the above-described configuration, even when the first input/output electrode is located at an asymmetric position on the other main surface of the multilayer body, the insertion loss of the first input/output path and the insertion loss of the second input/output path are equal or substantially equal to each other with high accuracy.

In high-frequency electronic components according to preferred embodiments of the present invention, even when a first input/output electrode is located at an asymmetric position on the other main surface of a multilayer body, insertion loss of a first input/output path and insertion loss of a second input/output path are equal or substantially equal to each other.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
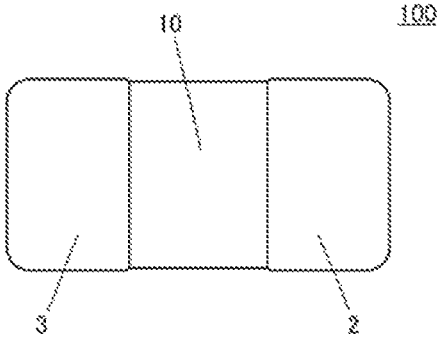
FIGS. 1A to 1D are outer appearance views of one side surface, one main surface (bottom surface), the other main surface (upper surface), and one end surface of a high-frequency electronic component according to a first preferred embodiment of the present invention.

Hereinafter, characteristics of the present invention will be described in detail by explaining preferred embodiments of the present invention. As high-frequency electronic components to which preferred embodiments of the present invention are applied, a divider and a combiner of a mobile communication apparatus such as a cellular phone are exemplified. However, high-frequency electronic components according to preferred embodiments of the present invention are not limited thereto.

First Preferred Embodiment

A high-frequency electronic component 100 according to a first preferred embodiment of the present invention will be described with reference to FIG. 1A to FIG. 4. The respective drawings are schematic views and dimensions of actual products are not necessarily reflected in the drawings. Furthermore, variations and the like of shapes of respective components, which are produced according to a manufacturing process, are not necessarily reflected in the respective drawings. That is to say, the drawings that will be referred to hereinafter can be said to illustrate actual products essentially even when they have differences from the actual products.

Figure 1D:
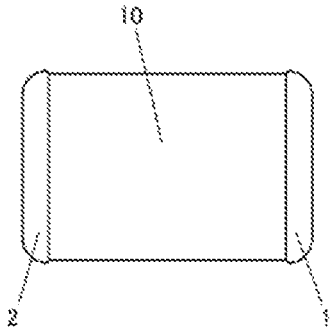
Figure 1B:
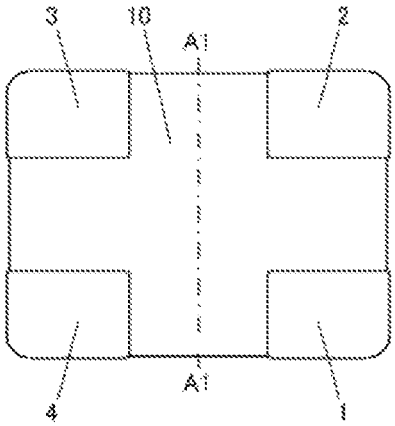
Figure 1C:
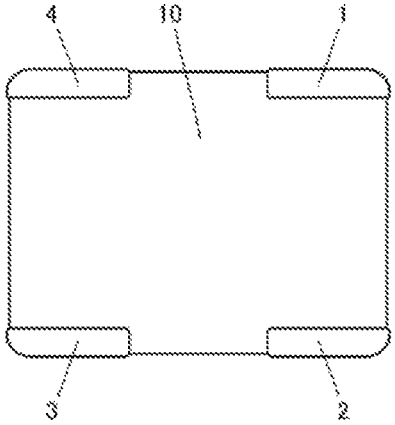
Figure 2:
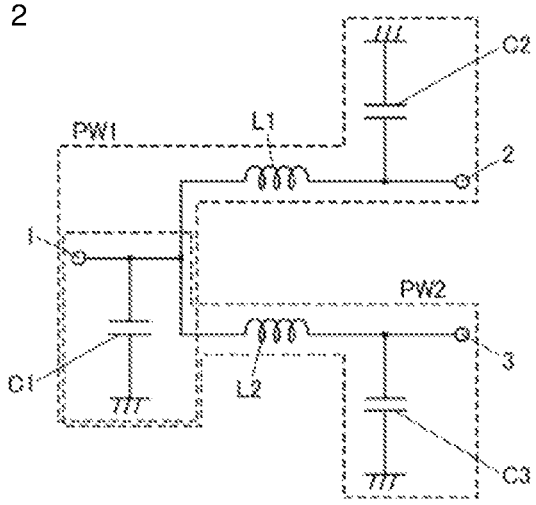
FIG. 2 is a circuit diagram of the high-frequency electronic component.
Figure 3:
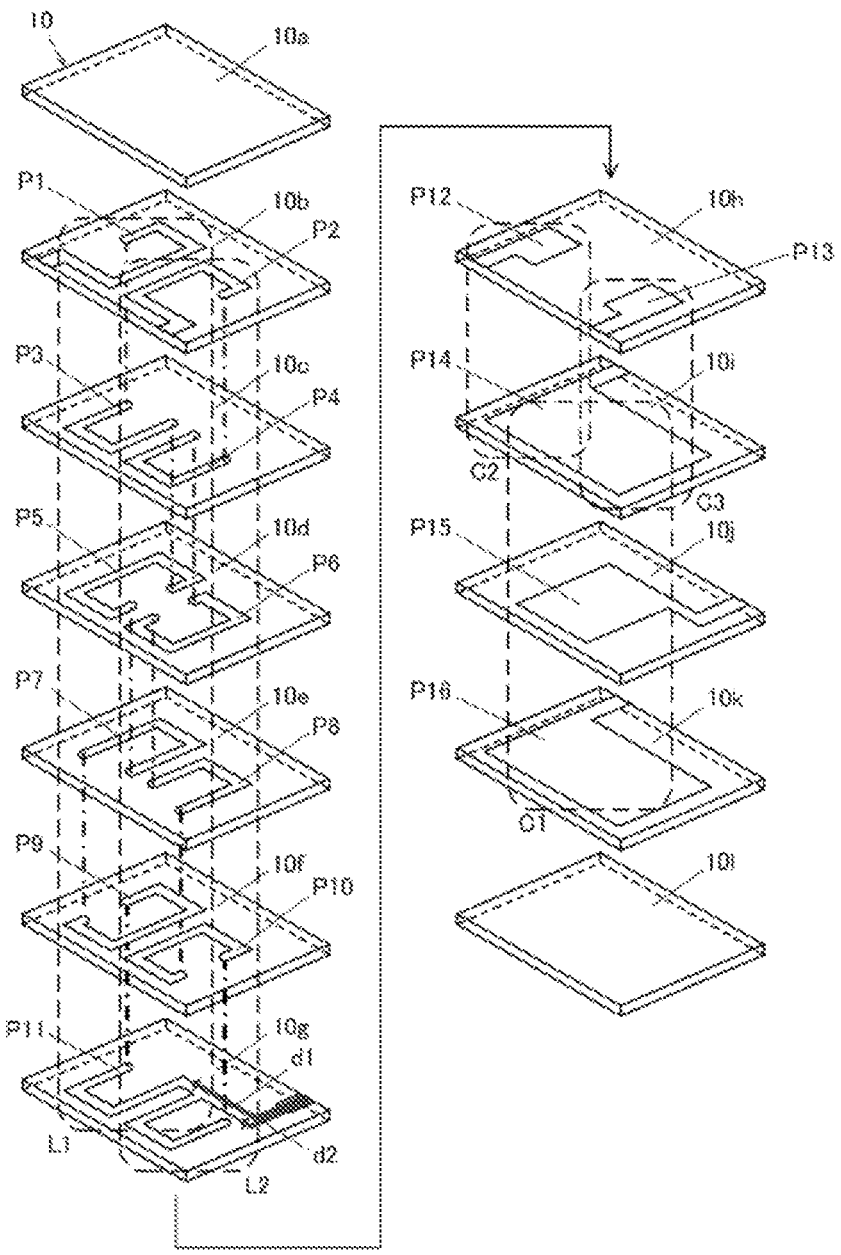
FIG. 3 is an exploded perspective view of a multilayer body included in the high-frequency electronic component.
Figure 4:
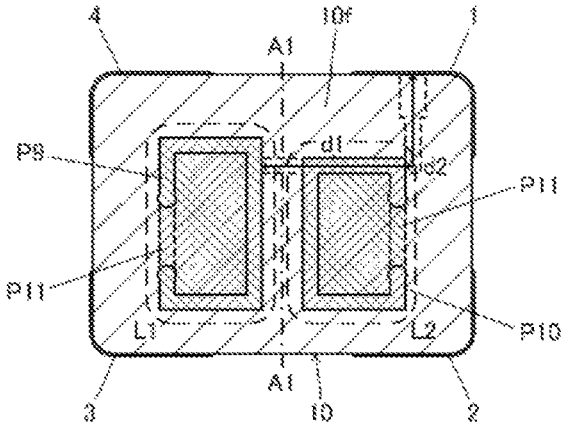
FIG. 4 is a see-through plan view in which an insulating layer in the multilayer body is exposed when seen from above.

FIGS. 1A to 1D are outer appearance views of the high-frequency electronic component 100. FIG. 1A is the outer appearance view of the side surface, FIG. 1B is the outer appearance view of one main surface (bottom surface), FIG. 1C is the outer appearance view of the other main surface (upper surface), and FIG. 1D is the outer appearance view of the end surface. FIG. 2 is a circuit diagram of the high-frequency electronic component 100. FIG. 3 is an exploded perspective view of a multilayer body 10 included in the high-frequency electronic component 100. FIG. 4 is a see-through plan view in which an insulating layer 10*f* in the multilayer body 10 is exposed when seen from above.

The high-frequency electronic component 100 preferably is a divider or a combiner, for example. The divider and the combiner preferably have the same or substantially the same circuit configuration other than the directions of input and output. The high-frequency electronic component 100 includes the multilayer body 10 preferably having a rectangular or substantially rectangular parallelepiped shape and four outer electrodes, for example. The rectangular or substantially rectangular parallelepiped shape is a concept that also includes a cubic or substantially cubic shape, for example. It should be noted that corner portions of the multilayer body 10 may be chamfered as long as the multilayer body 10 has the rectangular or substantially rectangular parallelepiped shape macroscopically as illustrated in FIGS. 1A to 1D. The outer electrodes include two outer electrodes provided over the one main surface, one side surface, and the other main surface of the multilayer body 10 and two outer electrodes provided over the one main surface, the other side surface, which opposes the one side surface, and the other main surface.

The two outer electrodes provided at the one side surface side of the multilayer body 10 are a first input/output electrode 1 and a ground electrode 4. The two outer electrodes provided at the other side surface side are a second input/output electrode 2 and a third input/output electrode 3. The first input/output electrode 1 is an input electrode of the divider or an output electrode of the combiner, and the second input/output electrode 2 and the third input/output electrode 3 are output electrodes of the divider or input electrodes of the combiner.

The first input/output electrode 1 is arranged in a vicinity of or adjacent to a corner portion, at one end portion side, of the one main surface of the multilayer body 10. Furthermore, the ground electrode 4 is arranged in a vicinity of or adjacent to a corner portion, at the other end portion side, of the one main surface of the multilayer body 10. The second input/output electrode 2 is arranged in a vicinity of or adjacent to another corner portion, at the one end portion side, of the one main surface of the multilayer body 10 so as to oppose the first input/output electrode 1. The third input/output electrode 3 is arranged in a vicinity of or adjacent to another corner portion, at the other end portion side, of the one main surface of the multilayer body 10 so as to oppose the ground electrode 4.

The second input/output electrode 2 and the third input/output electrode 3 are arranged at line symmetrical positions with respect to a symmetric axis (line A1-A1 in FIG. 1B) along the short-side direction of the one main surface of the multilayer body 10. The symmetric axis along the short-side direction of the one main surface of the multilayer body 10 is one of two symmetric axes of the one main surface having the rectangular or substantially rectangular shape and is a symmetric axis that is parallel or substantially parallel with the short sides of the one main surface. Furthermore, the rectangular or substantially rectangular shape is a concept including a square or substantially square shape, for example. When the one main surface has the square or substantially square shape, the symmetric axis along the short-side direction of the one main surface is defined as a symmetric axis that is parallel or substantially parallel with the direction perpendicular or substantially perpendicular to the one side surface and the other side surface.

The multilayer body 10 includes insulating layers 10*a* to 101 and pattern conductors P1 to P16. In the multilayer body 10, the pattern conductors P1, P3, P5, P7, P9, and P11 (one branches) are connected with via conductors (indicated by dashed-dotted lines) and define a first inductor L1. In the same manner, the pattern conductors P2, P4, P6, P8, P10, and P11 (the other branches) define a second inductor L2.

The pattern conductor P14, P15, and P16 define a first capacitor C1. The pattern conductors P12 and P14 define a second capacitor C2. The pattern conductors P13 and P14 define a third capacitor C3.

In the high-frequency electronic component 100, a projection view of the first capacitor C1 is line symmetric by itself with respect to the symmetric axis along the short-side direction of the other main surface of the multilayer body 10. A projection view of the second capacitor C2 and a projection view of the third capacitor C3 are line symmetric to each other with respect to the symmetric axis (line A1-A1 in FIG. 1B) along the short-side direction of the other main surface of the multilayer body 10.

The pattern conductors P11 and P15 are connected to the first input/output electrode 1. The pattern conductors P2 and P13 are connected to the second input/output electrode 2. The pattern conductors P1 and P12 are connected to the third input/output electrode 3. The pattern conductors P14 and P16 are connected to the ground electrode 4. Accordingly, one ends of the first capacitor C1, the second capacitor C2, and the third capacitor C3 are grounded during operation of the high-frequency electronic component 100.

That is to say, the first input/output electrode 1, the first inductor L1, the first capacitor C1 and the second capacitor C2 both of which are grounded, and the second input/output electrode 2 define a first input/output path PW1. The first input/output electrode 1, the second inductor L2, the first capacitor C1 and the third capacitor C3 both of which are grounded, and the third input/output electrode 3 define a second input/output path PW2 (see FIG. 2).

As described above, the first input/output electrode 1 is not arranged on the symmetric axis along the short-side direction of the other main surface of the multilayer body 10. Accordingly, a distance d1 from the first input/output electrode 1 to a winding portion of the first inductor L1 is larger than a distance d2 from the first input/output electrode 1 to a winding portion of the second inductor L2 (see FIG. 4).

In the high-frequency electronic component 100, the area of a region surrounded by the outer circumference of a projection view of the first inductor L1 is larger than the area of a region surrounded by the outer circumference of a projection view of the second inductor L2. With this, an inductance of the first inductor is larger than an inductance of the second inductor.

The area of the region surrounded by the outer circumference of the projection view of the first inductor L1 is the area of an inner side portion of the region surrounded by the outer circumference of a ring-shaped or substantially ring-shaped projection view at one side, which is obtained by superimposition of the pattern conductor P9 provided on the insulating layer 10*f* and one branch of the pattern conductor P11 provided on the insulating layer 10*g*, for example, as illustrated in FIG. 4 (a shaded portion at the left side in FIG. 4).

In the same manner, the area of the region surrounded by the outer circumference of the projection view of the second inductor L2 is the area of an inner side portion of the region surrounded by the outer circumference of a ring-shaped or substantially ring-shaped projection view at the other side, which is obtained by superimposition of the pattern conductor P10 provided on the insulating layer 10*f* and the other branch of the pattern conductor P11 provided on the insulating layer 10*g*, for example (a shaded portion at the right side in FIG. 4).

In the high-frequency electronic component 100, for example, the length of the pattern conductor P9 of the first inductor L1 is larger than the length of the pattern conductor P10 of the second inductor L2. Furthermore, the lengths of the other pattern conductors of the first inductor L1 are also larger than the lengths of the pattern conductors of the second inductor L2 if needed.

It should be noted that the above-described distance d1 is a distance from the first input/output electrode 1 to the ring-shaped or substantially ring-shaped projection view at the one side. In the same manner, the distance d2 is a distance from the first input/output electrode 1 to the ring-shaped or substantially ring-shaped projection view at the other side (see FIG. 4).

With the above-described configuration, the high-frequency electronic component 100 compensates for a difference in insertion loss, which is generated because the distance d1 is larger than the distance d2. As a result, the difference between the insertion loss of the first input/output path PW1 and the insertion loss of the second input/output path PW2 is decreased to a difference in a range of generating no problem in an actual usage environment, for example, a difference of approximately ±0.05 dB. That is, they are substantially identical to each other, for example.

Second Preferred Embodiment

A high-frequency electronic component 100A according to a second preferred embodiment of the present invention will be described with reference to FIG. 5 and FIG. 6. The high-frequency electronic component 100A is different from the high-frequency electronic component 100 in shapes of pattern conductors included in a multilayer body. Other components thereof are common to those of the high-frequency electronic component 100 and description of the common components are therefore omitted in some cases.

Figure 5:
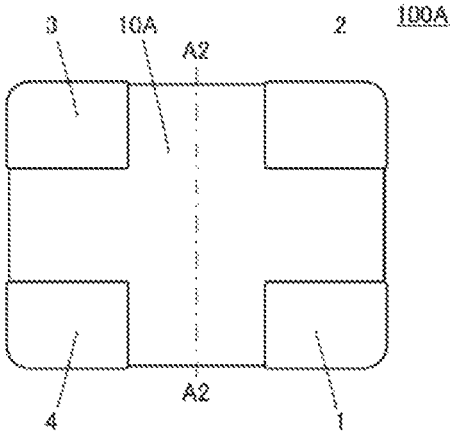
FIG. 5 is an outer appearance view of one main surface (bottom surface) of a high-frequency electronic component according to a second preferred embodiment of the present invention.
Figure 6:
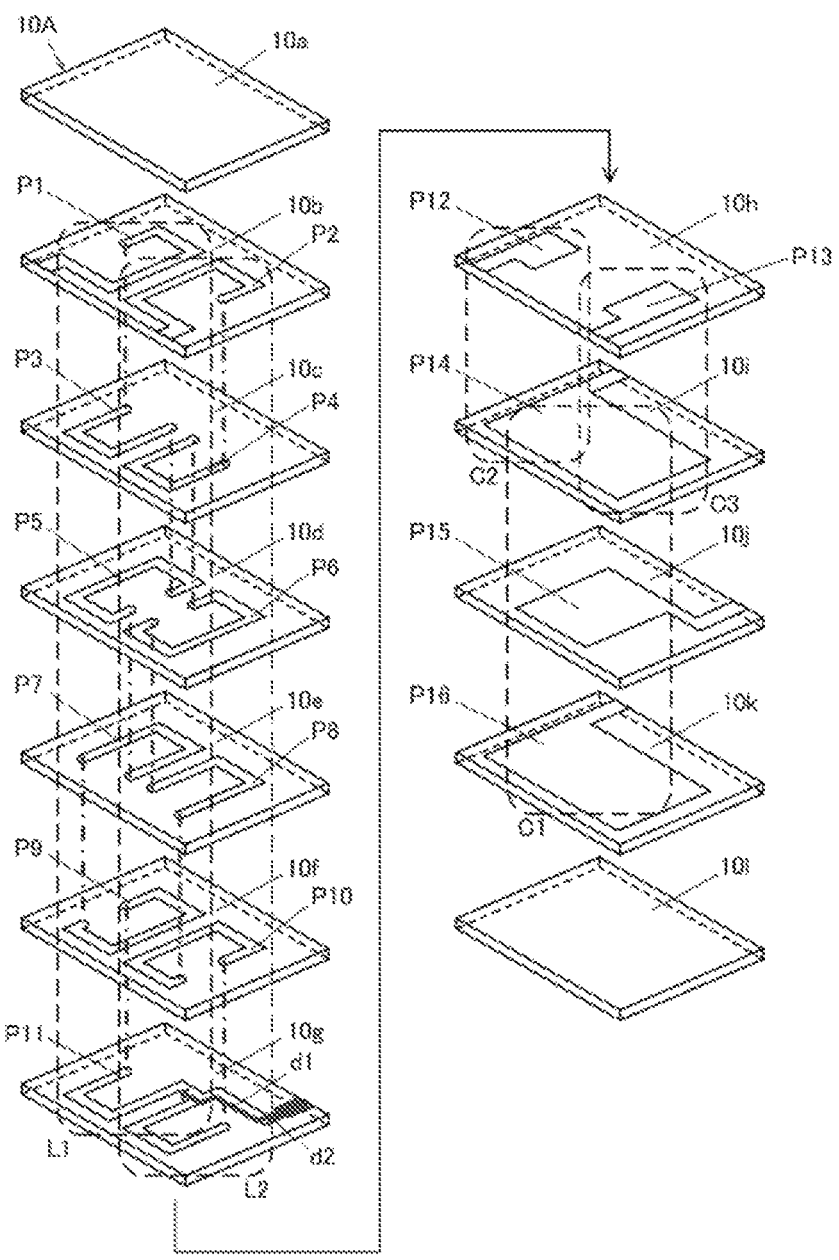
FIG. 6 is an exploded perspective view of a multilayer body included in a high-frequency electronic component according to a preferred embodiment of the present invention.

FIG. 5 is an outer appearance view of one main surface (bottom surface) of the high-frequency electronic component 100A. FIG. 6 is an exploded perspective view of a multilayer body 10A included in the high-frequency electronic component 100A. The outer appearance of the high-frequency electronic component 100A is preferably the same as that of the high-frequency electronic component 100. The arrangements of the first input/output electrode 1, the second input/output electrode 2, the third input/output electrode 3, and the ground electrode 4 and connection relations thereof to the pattern conductors are also the same as those in the high-frequency electronic component 100. Accordingly, also in the high-frequency electronic component 100A, the distance d1 from the first input/output electrode 1 to the winding portion of the first inductor L1 is larger than the distance d2 from the first input/output electrode 1 to the winding portion of the second inductor L2.

In the high-frequency electronic component 100A, projection views of the first inductor L1 and the second inductor L2 are line symmetric to each other with respect to a symmetric axis (line A1-A2 in FIG. 5) along the short-side direction of the other main surface of the multilayer body 10A when the multilayer body 10A is seen through from the other main surface (upper surface).

In the high-frequency electronic component 100A, the area of a projection view of the second capacitor C2 is smaller than the area of a projection view of the third capacitor C3. With this, a capacitance of the second capacitor is smaller than a capacitance of the third capacitor.

The projection view of the second capacitor C2 is a rectangular or substantially rectangular region at one side, which is obtained by superimposition of the pattern conductor P12 provided on the insulating layer 10*h* and a portion of the pattern conductor P14 provided on the insulating layer 10*i*. In the same manner, the projection view of the third capacitor C3 is a rectangular or substantially rectangular region at the other side, which is obtained by superimposition of the pattern conductor P13 provided on the insulating layer 10*h* and a portion of the pattern conductor P14 provided on the insulating layer 10*i*. In the high-frequency electronic component 100A, the area of the pattern conductor P12 of the second capacitor C2 is smaller than the area of the pattern conductor P13 of the third capacitor C3.

With the above-described configuration, the high-frequency electronic component 100A is able to compensate for a difference in insertion loss, which is generated because the distance d1 is larger than the distance d2. As a result, the insertion loss of the first input/output path PW1 and the insertion loss of the second input/output path PW2 are identical or substantially identical to each other in the same manner as the high-frequency electronic component 100.

Variation of Second Preferred Embodiment

A high-frequency electronic component 100B according to a variation of the second preferred embodiment of the present invention will be described with reference to FIG. 7 and FIG. 8. The high-frequency electronic component 100B is also different from the high-frequency electronic component 100 in shapes of pattern conductors included in a multilayer body. Other components thereof are common to those of the high-frequency electronic components 100 and 100A and description of the common components are therefore omitted in some cases.

Figure 7:
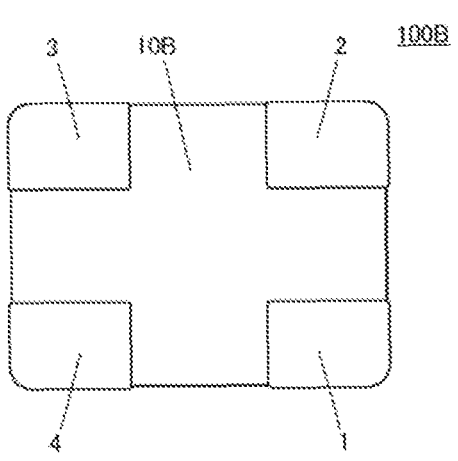
FIG. 7 is an outer appearance view of one main surface (bottom surface) of a high-frequency electronic component as a variation of the second preferred embodiment of the present invention.
Figure 8:
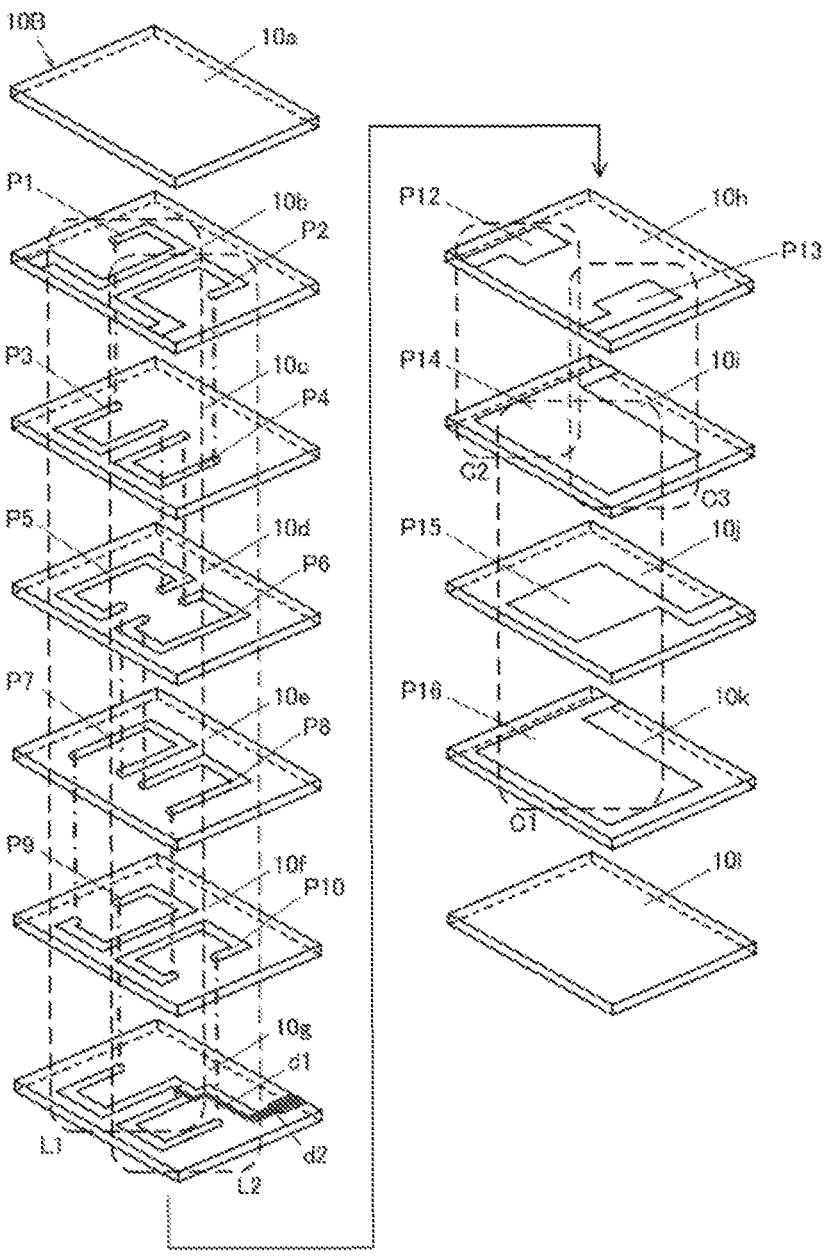
FIG. 8 is an exploded perspective view of a multilayer body included in a high-frequency electronic component according to a preferred embodiment of the present invention.
Figure 9:
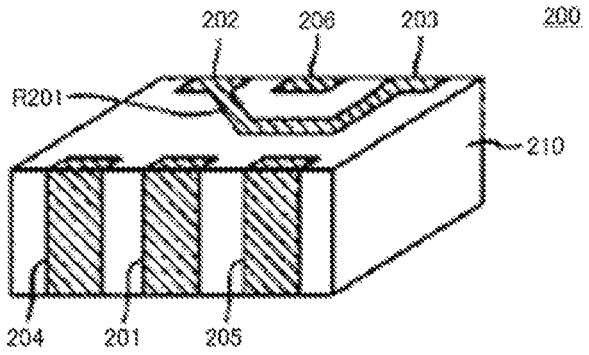
FIG. 9 PRIOR ART
FIG. 9 is an outer appearance view of a high-frequency electronic component according to a background art.
Figure 10:
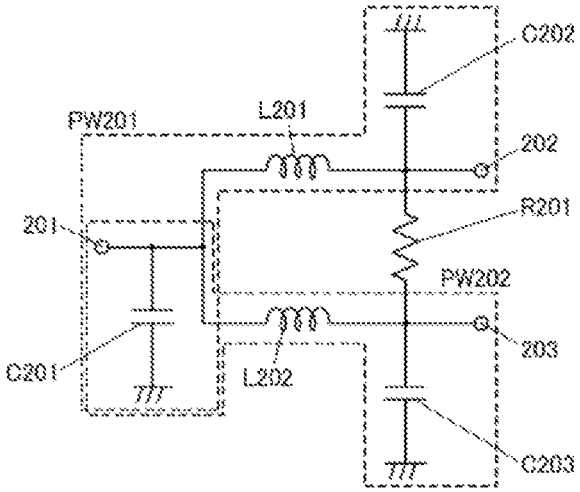
FIG. 10 PRIOR ART
FIG. 10 is a circuit diagram of the high-frequency electronic component of FIG. 9.
Figure 11:
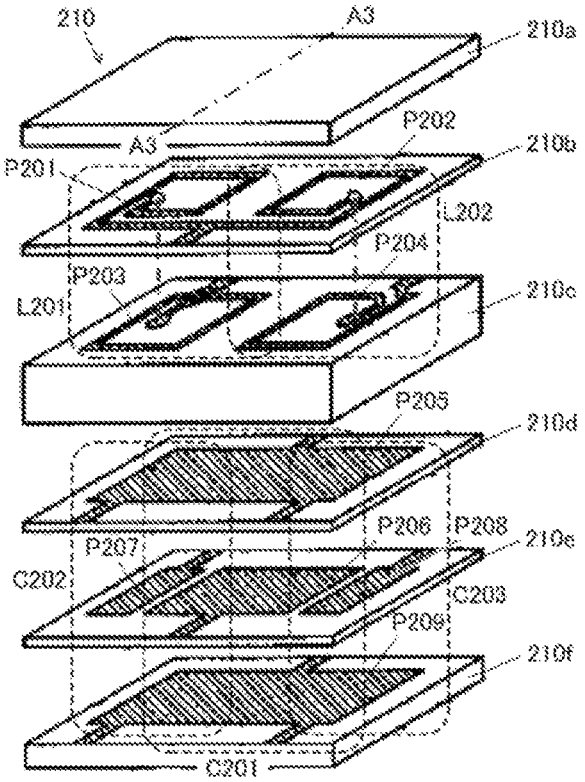
FIG. 11 PRIOR ART
FIG. 11 is an exploded perspective view of a multilayer body included in the high-frequency electronic component of FIG. 9.

FIG. 7 is an outer appearance view of one main surface (bottom surface) of the high-frequency electronic component 100B. FIG. 8 is an exploded perspective view of a multilayer body 10B included in the high-frequency electronic component 100B. The configuration of the high-frequency electronic component 100B is also the same as that of the high-frequency electronic component 100. Accordingly, the distance d1 from the first input/output electrode 1 to the winding portion of the first inductor L1 is larger than the distance d2 from the first input/output electrode 1 to the winding portion of the second inductor L2.

In the high-frequency electronic component 100B, the area of a region surrounded by the outer circumference of a projection view of the first inductor L1 is larger than the area of a region surrounded by the outer circumference of a projection view of the second inductor L2. In the high-frequency electronic component 100B, for example, the length of the pattern conductor P9 of the first inductor L1 is larger than the length of the pattern conductor P10 of the second inductor L2 as in the above-described high-frequency electronic component 100. Furthermore, the area of the pattern conductor P12 of the second capacitor C2 is smaller than the area of the pattern conductor P13 of the third capacitor C3 as in the high-frequency electronic component 100A.

With the above-described configuration, the high-frequency electronic component 100B is able to compensate a difference in insertion loss, which is generated because the distance d1 is larger than the distance d2, with high accuracy. As a result, the insertion loss of the first input/output path PW1 and the insertion loss of the second input/output path PW2 are identical to each other with high accuracy.

The present invention is not limited to the above-described preferred embodiments and various applications and variations can be added in the scope of the present invention. Furthermore, it should be noted that the respective preferred embodiments described in the specification are exemplary and partial replacement or combination of components among the different preferred embodiments can be made.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A high-frequency electronic component comprising:

a multilayer body including a first input/output electrode provided on one main surface and one side surface of the multilayer body, and a second input/output electrode and a third input/output electrode provided on the one main surface and one other side surface, which opposes the one side surface, of the multilayer body; and a first input/output path including the first input/output electrode, the second input/output electrode, and a first inductor and a first capacitor connected between the first input/output electrode and the second input/output electrode, and a second input/output path including the first input/output electrode, the third input/output electrode, and a second inductor and the first capacitor connected between the first input/output electrode and the third input/output electrode; wherein the first input/output electrode is provided at a position deviated from a symmetric axis along a short-side direction of the one main surface of the multilayer body;

a distance from the first input/output electrode to a winding portion of the first inductor is larger than a distance from the first input/output electrode to a winding portion of the second inductor; and an inductance of the first inductor is larger than an inductance of the second inductor.

2. The high-frequency electronic component according to claim 1, wherein an area of a region surrounded by an outer circumference of a projection view of the first inductor is larger than an area of a region surrounded by an outer circumference of a projection view of the second inductor.

3. The high-frequency electronic component according to claim 1, wherein the multilayer body has a rectangular or substantially rectangular parallelepiped shape.

4. The high-frequency electronic component according to claim 1, wherein the high-frequency electronic component is a divider.

5. The high-frequency electronic component according to claim 1, wherein the high-frequency electronic component is a combiner.

6. The high-frequency electronic component according to claim 1, wherein the first input/output electrode is located in a vicinity of or adjacent to a first corner portion of the multilayer body;

the second input/output electrode is located in a vicinity of or adjacent to a second corner portion of the multilayer body so as to oppose the first input/output electrode; and the third input/output electrode is located in a vicinity of or adjacent to a third corner portion of the multilayer body so as to oppose a ground electrode.

7. The high-frequency electronic component according to claim 1, wherein the second input/output electrode and the third input/output electrode are arranged at line symmetrical positions with respect to the symmetric axis along the short-side direction of the one main surface of the multilayer body.

8. The high-frequency electronic component according to claim 1, wherein a length of a pattern conductor of the first inductor is larger than a length of a pattern conductor of the second inductor.

9. A high-frequency electronic component comprising:

a multilayer body including a first input/output electrode provided on one main surface and one side surface of the multilayer body, and a second input/output electrode and a third input/output electrode provided on the one main surface and the other side surface, which opposes the one side surface, of the multilayer body; and a first input/output path including the first input/output electrode, the second input/output electrode, and a first inductor, and a first capacitor and a second capacitor connected between the first input/output electrode and the second input/output electrode, and a second input/output path including the first input/output electrode, the third input/output electrode, and a second inductor, and the first capacitor and a third capacitor connected between the first input/output electrode and the third input/output electrode; wherein the first input/output electrode is provided at a position deviated from a symmetric axis along a short-side direction of the one main surface of the multilayer body;

a distance from the first input/output electrode to a winding portion of the first inductor is larger than a distance from the first input/output electrode to a winding portion of the second inductor; and a capacitance of the second capacitor is smaller than a capacitance of the third capacitor.

10. The high-frequency electronic component according to claim 9, wherein an area of a projection view of the second capacitor is smaller than an area of a projection view of the third capacitor.

11. The high-frequency electronic component according to claim 10, wherein an area of a region surrounded by an outer circumference of a projection view of the first inductor is larger than an area of a region surrounded by an outer circumference of a projection view of the second inductor.

12. The high-frequency electronic component according to claim 9, wherein the multilayer body has a rectangular or substantially rectangular parallelepiped shape.

13. The high-frequency electronic component according to claim 9, wherein the high-frequency electronic component is a divider.

14. The high-frequency electronic component according to claim 9, wherein the high-frequency electronic component is a combiner.

15. The high-frequency electronic component according to claim 9, wherein the first input/output electrode is located in a vicinity of or adjacent to a first corner portion of the multilayer body;

the second input/output electrode is located in a vicinity of or adjacent to a second corner portion of the multilayer body so as to oppose the first input/output electrode; and the third input/output electrode is located in a vicinity of or adjacent to a third corner portion of the multilayer body so as to oppose a ground electrode.

16. The high-frequency electronic component according to claim 9, wherein the second input/output electrode and the third input/output electrode are arranged at line symmetrical positions with respect to the symmetric axis along the short-side direction of the one main surface of the multilayer body.

17. The high-frequency electronic component according to claim 9, wherein a length of a pattern conductor of the first inductor is larger than a length of a pattern conductor of the second inductor.

* * * * *